US006032386A

United States Patent [19]

Evans

[11] Patent Number: 6,032,386

[45] Date of Patent: Mar. 7, 2000

[54] GOLF SHOE WITH REMOVABLE SOLE

[75] Inventor: Harold A. Evans, Swampscott, Mass.

[73] Assignee: Partners In Innovation, LLC, Manchester, N.H.

[21] Appl. No.: 09/103,678

[22] Filed: Jun. 23, 1998

[51] Int. Cl.[7] ..... A43B 5/00; A43C 15/00

[52] U.S. Cl. ..... 36/15; 36/134; 36/127; 36/61

[58] Field of Search ..... 36/15, 127, 134, 36/135, 61, 7.6

[56] References Cited

U.S. PATENT DOCUMENTS

| | | | |
|---|---|---|---|
| 1,702,800 | 2/1929 | Silvey | 36/135 |
| 3,020,654 | 2/1962 | McCann | 36/135 |
| 3,538,628 | 11/1970 | Einstein, Jr. | 36/15 |
| 3,878,626 | 4/1975 | Isman | 36/15 |
| 4,271,608 | 6/1981 | Tomuro | 36/61 |
| 5,722,189 | 3/1998 | Johnson | 36/135 |

*Primary Examiner*—M. D. Patterson
*Attorney, Agent, or Firm*—William A. Loginov

[57] ABSTRACT

A sport shoe, particularly suitable for golf, provides a shoe with a base section sole and an overlying sole that is selectively removable from the base section sole. The base section sole can be spikeless, or include one type of spikes, while one or more overlying soles can include different spike types or spikeless faces. In one example, the base section sole contains metal long spikes that seat within magnetic recesses of the overlying sole. The overlying sole includes short plastic spikes or a spikeless face.

4 Claims, 6 Drawing Sheets

GOLF SHOE WITH REMOVABLE SOLE

FIELD OF THE INVENTION

This invention relates to sport or athletic shoes and more particularly to golf shoes and the like having spikes and cleats attached to the undersides of their soles.

BACKGROUND OF THE INVENTION

Shoes used for playing golf and other field sports often include spikes or cleats that extend from the bottom of their respective soles. These spikes or cleats enhance the wearer's grip on soft surfaces such as turf. The spikes are typically removable, including male threads that engage corresponding female threads disposed in holes at predetermined locations on the bottom of the sole.

Particularly in the sport of golf, spiked shoes have become an essential element of equipment. While long metal spikes are often preferred for golf play on open fairways, golf courses have become stricter about the use of such spikes. Long metal spikes are believed to damage delicate greens and other low-cut turf. Many golf courses now require that alternative spikes, sold commercially under the trademark Soft Spikes™ (herein to be termed "short spikes") be worn. These short spikes are commercially available from various sources. One popular style of short spike comprises a dome-like base approximately ¾ inch in diameter with a threaded root or stem section that is secured in a female threaded socket in the base of a normal golf shoe sole and has a plurality of small spikes projecting from each dome. Each of the small spikes is formed integrally with the domed base and projects no more than approximately ⅛–¼ inch. The spike is constructed from a durable plastic product such as polyethylene. While short spikes are acceptable for use on greens, they do not have the same gripping ability on fairways and other higher-grass areas as traditional long metal spikes.

In addition, an age-old problem in golf is that spikes are preferably removed before entering club houses and other structures, as well as when walking on hard surfaces, such as pavements and parking lots. While short spikes alleviate some of these problems, it is still preferable to wear a flat sole in these non-turf areas.

Accordingly, it is an object of this invention to provide an athletic shoe having a sole that enables the spike profile to be changed quickly and easily to meet different conditions. The sole should enable long spikes, short spikes and no spikes to be selectively provided to the bottom of the sole.

SUMMARY OF THE INVENTION

This invention overcomes the disadvantages of the prior art by providing an athletic shoe having sole with an underlying base section, typically having a set of long spikes or short spikes thereon and an overlying sole that is selectively removable from the base section. The overlying sole can include a different type of spike thereon or no spikes. The overlying sole is aligned with the base section using a variety of alignment/attachment mechanisms that can include the spikes on the underlying base section which become aligned with respective receiving holes on the overlying sole when it is positioned over the base section. The base section on the overlying sole can be joined by a set of interengaging connectors that can operate, for example, based upon magnetic attraction between the overlying sole and the base section. Alternatively, a hook-and-loop fastener system or other selectively removable adhesive system can be used. Clips can also be used between the overlying sole and the base section according to an alternate embodiment.

In a preferred embodiment, the base section includes a plurality of long spikes mounted therein. The overlying sole includes receiving holes that are aligned with the long spikes. The overlying sole can include either a flat, non-spiked surface with appropriate threads or short spikes. A series of magnets are provided on the interface of the overlying sole where it engages the base section. The magnets can be provided adjacent the alignment holes and can be attracted to the metal long spikes themselves or magnetic inserts can be provided adjacent the metal long spikes.

According to an alternate embodiment, portions of the face of the base section and confronting portions of the overlying sole can be provided with a commercially available flexible magnetic layer attached to an underlying portion of the sole, typically composed of metal or rubber, by appropriate adhesives. The confronting magnet portions form a positive, but removable, engagement mechanism.

BRIEF DESCRIPTION OF THE DRAWINGS

The foregoing and other object and advantages of the invention will become more clear with reference to the following detailed description as illustrated by the drawings in which.

DETAILED DESCRIPTION

Figure 1:
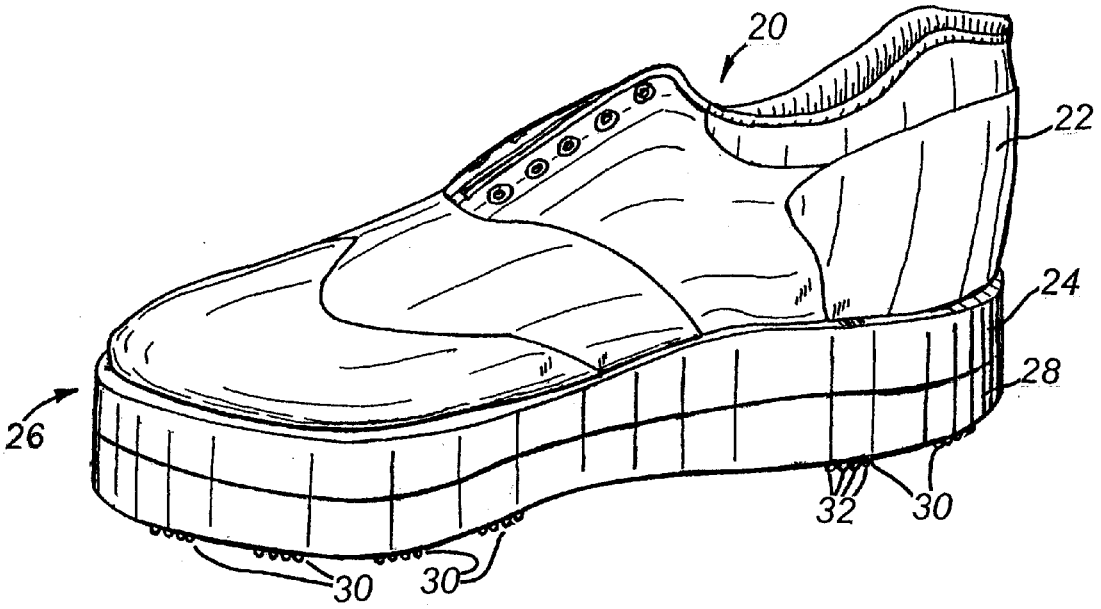
FIG. 1 is a perspective view of an athletic shoe with a sole having a spike system according to an embodiment of this invention.

FIG. 1 details a golf shoe 20 according to an embodiment of this invention. The shoe comprises an upper portion 22 of conventional design that is connected by stitches, adhesives and other conventional shoe joining structures to a base section sole 24. The base section sole comprises rubber, leather, a synthetic material or a combination of materials, generally acceptable for formation of a sole. In addition, the overall sole structure 26 comprises an overlying sole 28.

Figure 2:
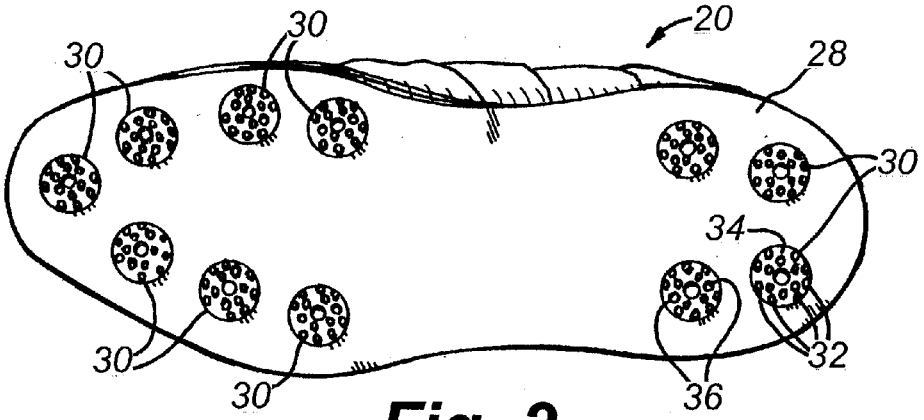
FIG. 2 is a bottom plan view of the shoe of FIG. 1 showing an overlying sole with short spikes thereon.

With further reference to FIG. 2, the overlying sole includes along its bottom, outer-facing face, a series of short spikes 30 formed as described above with plurality of individual small spikes 32 on a domed base 34. While not shown, the overlying sole 28 includes a plurality of threaded inserts, constructed from plastic or metal, or threaded directly into the sole material, for receiving the short spikes. Each soft spike can include a pair of insert holes 36 for receiving a special tool that enables the spike to be inserted and removed by turning the threaded spike into relative to the female sole insert.

Figure 3:
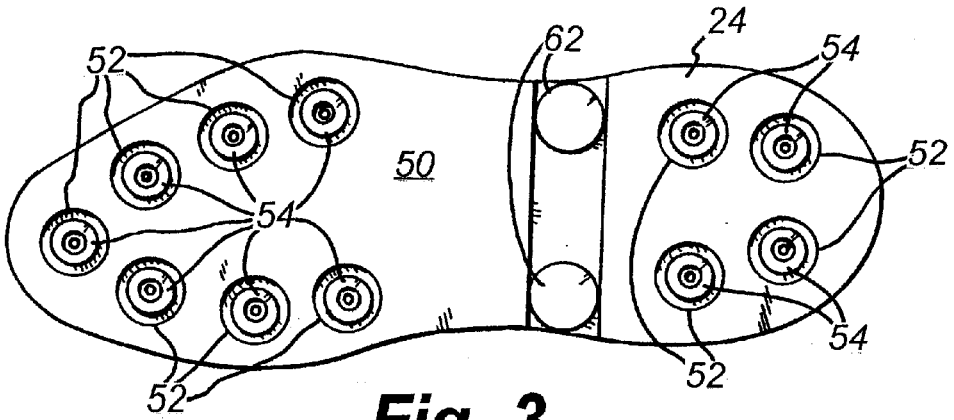
FIG. 3 is a top plan view of the shoe of FIG. 1 showing the confronting top surface overlying sole of FIG. 2.
Figure 4:
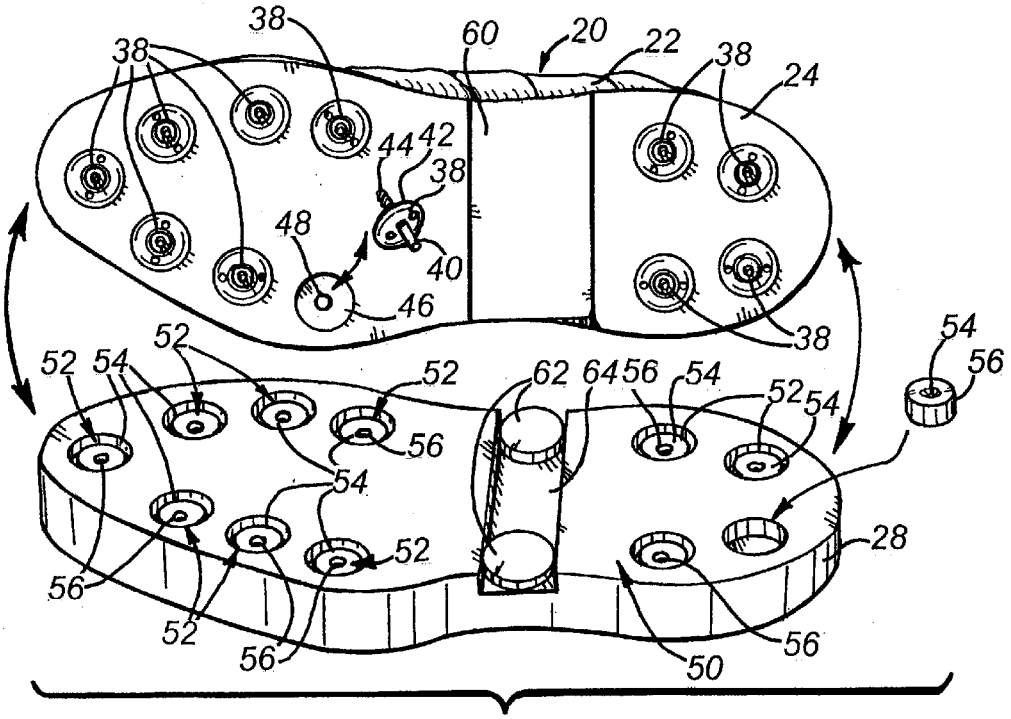
FIG. 4 is a somewhat schematic perspective view showing the attachment and/or removal of the overlying sole from the base section for the shoe of FIG. 1.

With further reference to FIGS. 3 and 4, the base section 24 of the sole includes a series of conventional long metal spikes 38 according to this embodiment. The construction of such metal spikes is well known. In general, it consists of a spike projection 40 a base 42 having appropriate holes for receiving a tool and a threaded male stem 44. The base section 24 is provided with a series of conventional threaded inserts 46 having female threaded holes 48 for receiving stems 44. The overlying sole 28 includes an inner confronting face 50 having a series of recesses 52 having a diameter that is as large or larger than the spike base 38. Each of the recessing include therein a magnetic disc 54 constructed from a conventional magnetic material, such as an iron composite magnet. Each disc is machined or otherwise formed so that it fits within the recess. The top face of each magnetic disc 54 sits below the surface of the confronting face 50. The depth below the surface can be approximately ⅛ inch. In general, the depth is chosen so that any projection of the spike base 38 falls with the recess 52, thus allowing the bottom face of the base section 24 to come into contact with the face 50 of the overlying sole.

Each magnetic insert 54 includes, in its center, a hole or well 56 having a depth and a diameter sufficient to receive individual spike extensions 40. The hole can be a straight through-hole in the insert, or can be contoured with a radius upper portion, tapering to a more-narrow hole within the depth of the insert. In any case, the hole should be sufficient to enable a spike extension 40 to seat within the hole 56. In this embodiment, since the spikes are metallic, they are attracted to the magnet inserts. Hence, when the overlying sole 28 is seated onto the base section 24, with each spike engaging a corresponding hole 56, the spikes and magnets will become attracted to each other, thus retaining the overlying sole to the base section. Of course, the inserts 54 are aligned with respective spikes to ensure proper seating. Additional magnets can be provided at different parts of the base section 24 and overlying sole 28 to enhance securement. For example, a metal or magnetic plate 60 is provided to the base section. Two or more corresponding magnets 62 are provided within a well 64 at the center of the overlying sole 28. These magnets 62 engage the plate 60. The well 64 also serves to provide a thinner section area to enable the overlying sole to flex. The overlying sole, like the base section, can be constructed from a variety of materials. Typically, a rubber material suitable for soles, and having sufficient flexibility, is used. Other material, however, such as leather are expressly contemplated. The thickness of the overlying sole and base section can be minimized, subject to the size limitations of the spikes. In general, it is desirable that the spike extensions 40 do not pass out of the underside of the overlying sole. The base section sole, likewise, should be thin enough to enable the threaded stems 44 to become fully seated in each hole 48, without passing into the interior of the shoe which, obviously, would be a cause for discomfort. An alternate embodiment, shorten stems are contemplated to enable the base section sole 24 to be made thinner. The inserts 46 can, themselves, be constructed from magnetic material with appropriate threaded sleeves for receiving spike stems 44. This would enhance the magnetic attraction to the overlying sole inserts 54. A variety of insert and spike geometries are contemplated to bring various parts of the spike, their base inserts (46) and the overlying sole inserts (54) into contact with each other to enhance magnetic attraction. Custom spikes of various sizes and shapes can be provided to facilitate contact.

While it is often desirable that the short spikes on the overlying sole 28 be aligned with the long spikes 40, it may be preferable, to maintain a thinner profile for the overlying sole 28 to place the threaded holes for the short spikes at an offset relative to the inserts 54. In this manner, the threaded stems of the short spikes will not come into contact with the inserts 54, which serves to further minimize the required thickness of the overlying sole 28.

Figure 5:
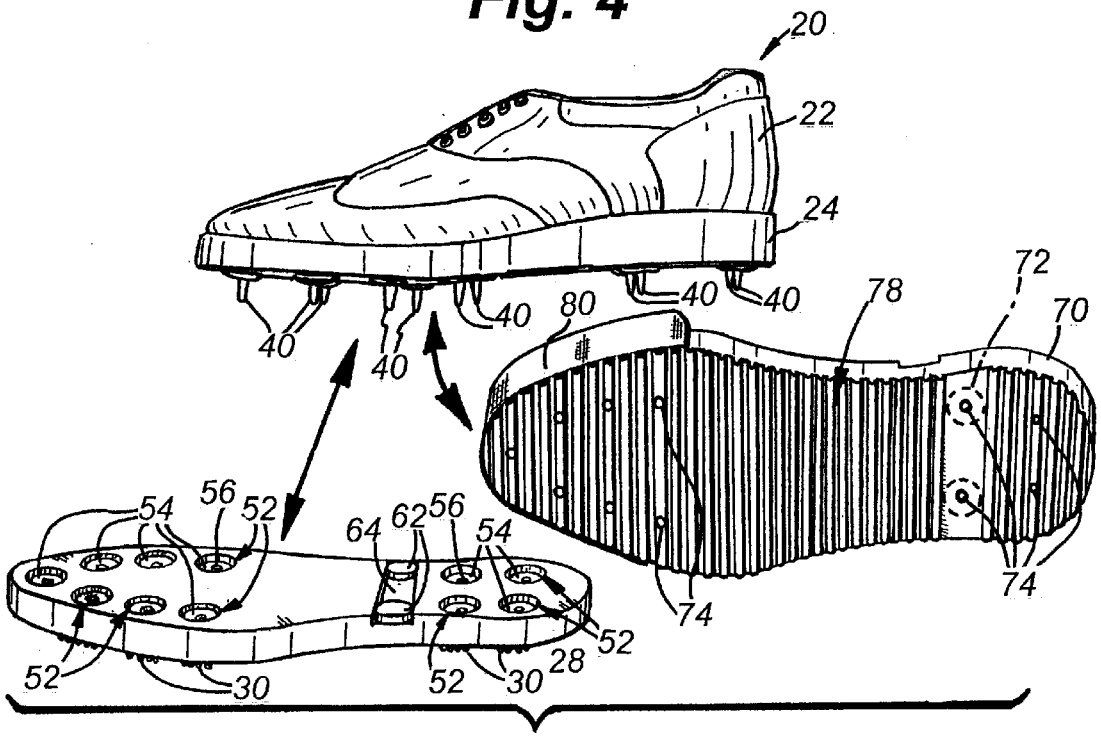
FIG. 5 is an exploded perspective view of the shoe of FIG. 1 showing the selection of two different overlying soles.
Figure 6:
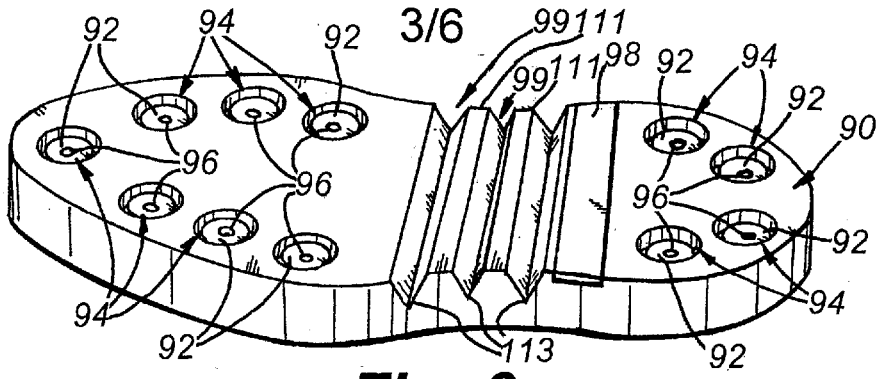
FIGS. 6 and 7 are perspective views of two alternate embodiments of overlying soles according to this invention detailing the interface thereof.

FIG. 5 illustrates the shoe 20 having its extended metal spikes 40 being selectively provided with the short spike overlying sole 28 as described above or a spikeless sole 70. The spikeless sole in this embodiment has similar magnetic inserts 72 (shown in phantom) to those in the short spike's overlying sole 28. These two overlying soles 28 and 70 allow the wearer to select between a shoe having only the base section with long spikes or a quickly changeable short spike section when approaching greens and other sensitive turf. In addition, when entering a club house or hard ground, the spikeless sole 70 can be selected. Note that the spikeless sole includes a series of holes 74 that are typically placed through the inserts 72. The holes may be through holes, extending through the bottom of the sole, as shown, or can be "blind" holes that do not extend through the bottom surface 78 of the sole 70. Note that, according to an alternate embodiment, the thickness of the sole 70 can be selected so that small portions of the spikes 40 actually extend through the hole 74, and out of the bottom face 78. This would allow a small low-profile spike to be used on greens. However, where a three-sole system is employed, such as that shown in FIG. 5, it is preferable that the spikes 40 not extend through the bottom surface 78. Such extension is, however, expressly contemplated according to alternate embodiments.

As described briefly above, the wearer applies each of the overlying soles 28 or 70 to the base section, when needed, by simply aligning the spikes 40 with appropriate holes 56 or 72. This can be accomplished while standing, by raising each shoe and overlying the overlaying sole or, alternatively, by laying each sole on a ground surface and stepping into it with appropriate alignment. Various alignment structures, such as side guides can be provided on the overlying sole to assist in aligning it with the base section 24. For example, the spikeless sole 70 includes a surrounding toe shield 80. A toe shield can be provided to any overlying sole shown herein. The toe shield helps to maintain front alignment of the base section 24 with the sole 70. Removal of the sole is the reverse of application. In general, the user lifts up his or her foot and physically pulls the overlying sole away from the base section. The magnetic force is chosen based upon the strength of the magnets used, and upon the number of magnets used and their overall area of engagement to make the interengagement between overlying sole and base sections sufficiently firm so that the sole will not become inadvertently removed during walking, but weak enough to allow a pulling hand, applying sufficient force to remove the overlying soles from the base section when desired. It is contemplated in alternative embodiments that magnets can be substituted or enhanced with clips of a variety of styles and sizes, hook and loop fasteners and, in some instances, pressure-sensitive adhesives. Such supplementary or alternate fasteners can be provided at various points along the soles to come into engagement with each other when the soles are properly aligned. When the term "interengaging connectors" is used, it is meant to describe a variety of different connecting structures, such as clips, magnets and the like. For example, the inserts 54 can form one part of a clip, while the extended spikes can include detents to form another part of a clip. These are considered interengaging connectors.

FIGS. 6, 7, 8 and 9 detail, respectively, two overlying soles 90 and 100 and two respective shoe base sections 110 and 120 showing different interengaging connector structures according to this invention. The overlying sole 90 (FIG. 6) includes a set of magnets 92, disposed in recesses 94 with holes 96 for receiving long spikes as described generally above. Also included is a flat plate 98 constructed from magnetic/attractive material such as steel. The sole also includes a series of ridges having peaks 111 and valleys that enhance the flexibility of the overlying sole, to facilitate walking. The ridges 99 are located between the front and rear spike sets.

The sole 90 (FIG. 6) is arranged to engage the shoe base section 114 having conventional metallic long spikes 116 as described above. The center of the shoe base section, between front and rear spike sets, includes a series of recessed annular magnets 118, mounted in a channel 119 for engaging the plate 98 on the overlying sole for enhanced holding force. The shape of the magnets is variable. As noted above, plates and corresponding magnets or other interengaging connector structures can be located at various positions on each of the base and overlying soles.

Another overlying sole 100 (FIG. 7) includes a set of recesses 122 with centered holes 124 sized and arranged to receive long spikes and their corresponding bases. The recesses can include magnets or other connectors, or as shown, can be inert structures. This sole also includes ridges 99 for enhances flexure in this embodiment. The confronting surface 132 of the sole 100 comprises a flexible, commercially available magnetic sheet according to this invention. Alternatively, a hook and loop fastener layer or another adhesive layer, allowing removal and replacement of the sole is contemplated. The surface 132 can be approximately 1/16–1/8 inch or more. In some embodiments, the layer is thick enough to allow clearance for the recesses 122 in their entirety, by forming appropriate diameter holes in the layer. In some other embodiments, the recess hole into the underlying sole 136 is further drilled to provide full clearance for each recess. The surface 132 is attached to the underlying sole 136 using any durable adhesive that is acceptable for shoes. In addition fasteners and stitching can aid in securing the surface 132 to the underlying sole 136.

Likewise, the base section 120 (FIG. 9) is arranged to receive the overlying sole 100. It includes a magnetic surface 140 that, like the surface 136 of the sole 100, can be adhered to an underlying sole of leather, rubber or the like. The surface 140 overlies substantially the entire sole 120 in this embodiment. It therefore engages the magnetic surface 132 on the overlying sole 100. The spikes 142 rest upon the surface 140, or can be set in recesses within the surface 140 according to an alternate embodiment. Again the surface 140 can be located on only portions of the overall sole, or can comprise an alternative structure such as a hook and loop material or a multi-use adhesive or tape. In general, the surface is designed for rapid removal and replacement of the overlying sole, and for firm attachment of the overlying sole on the base section when it is in place thereon.

Figure 7:
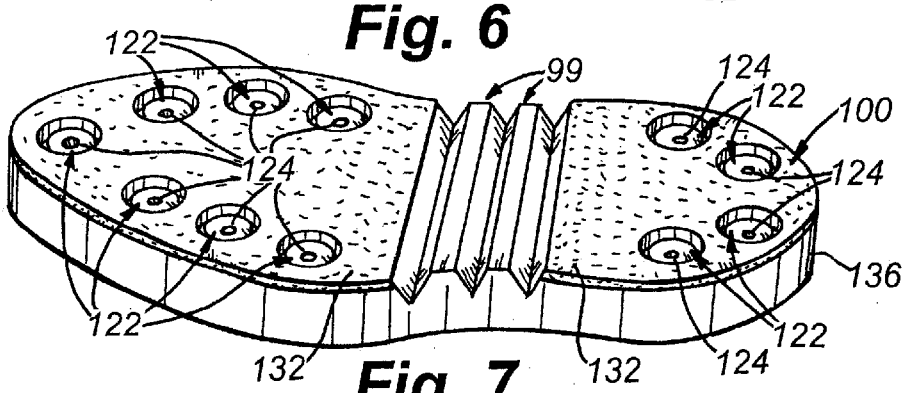
Figure 8:
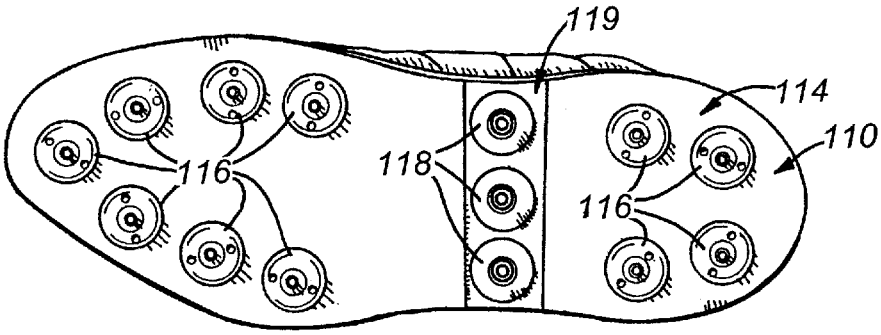
FIGS. 8 and 9 are bottom plan views of two alternate embodiments of the base section for the athletic shoe of this invention.
Figure 9:
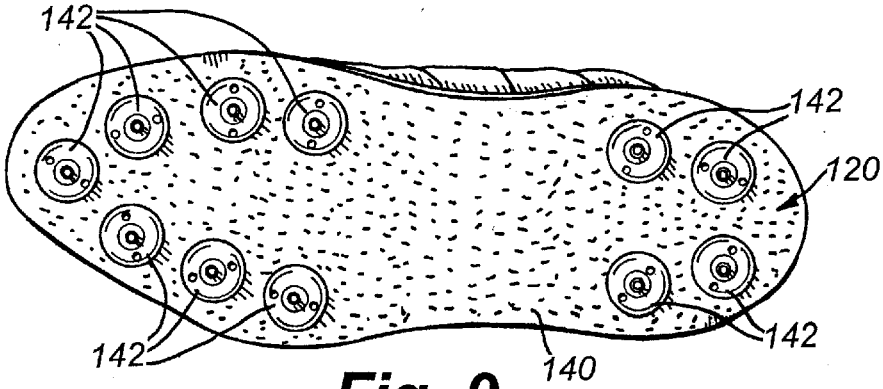

Note that the arrangement shown in FIGS. 7 and 9 makes possible the use of nonmagnetic spikes. For example, the base section can include short spikes according to this embodiment. As such overlying soles having long spikes and/or a spikeless surface can be used.

Figure 10:
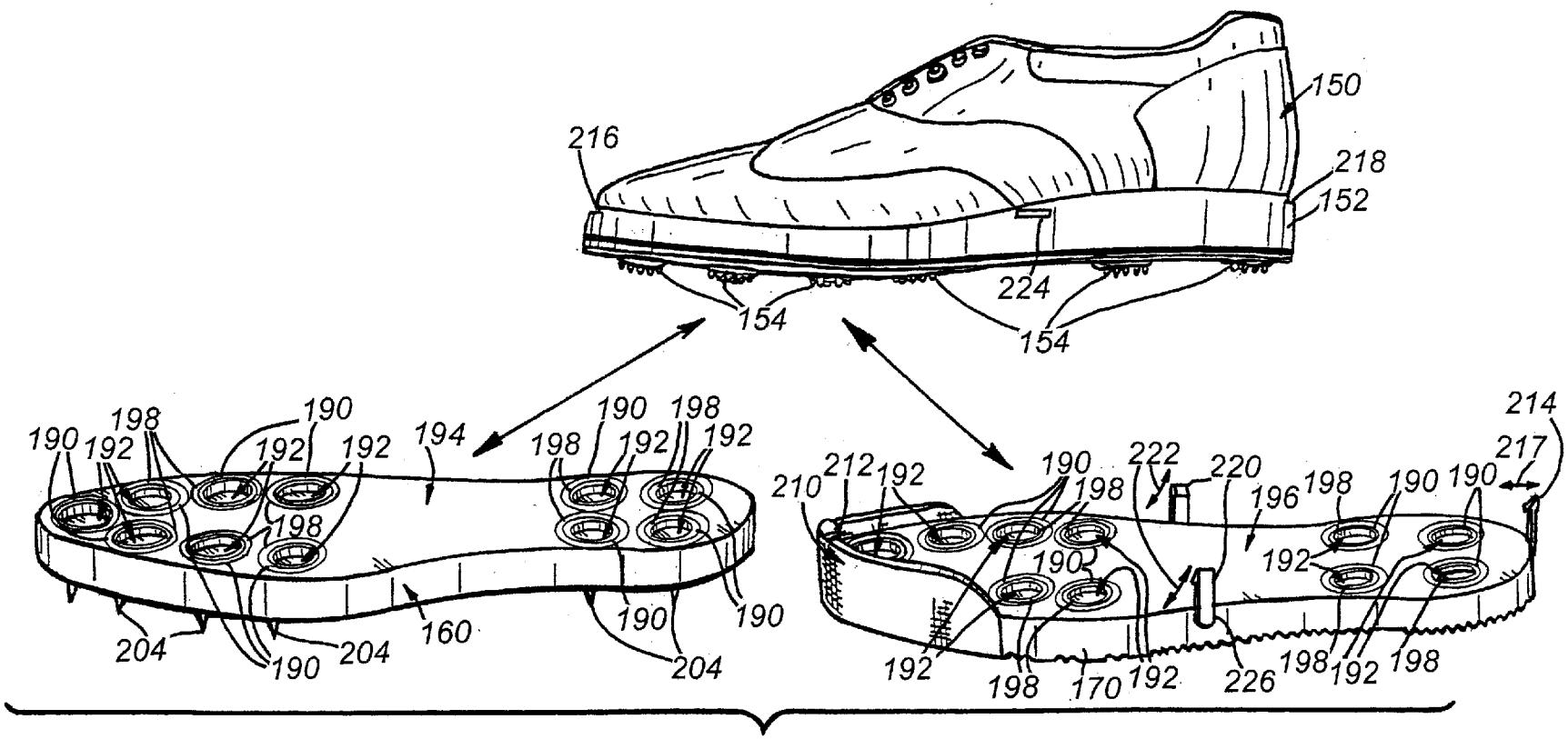
FIG. 10 an exploded perspective view of an alternate embodiment of the athletic shoe of this invention showing a base section having short spikes that receives overlying soles having a regular thread or long spikes thereon.
Figure 11:
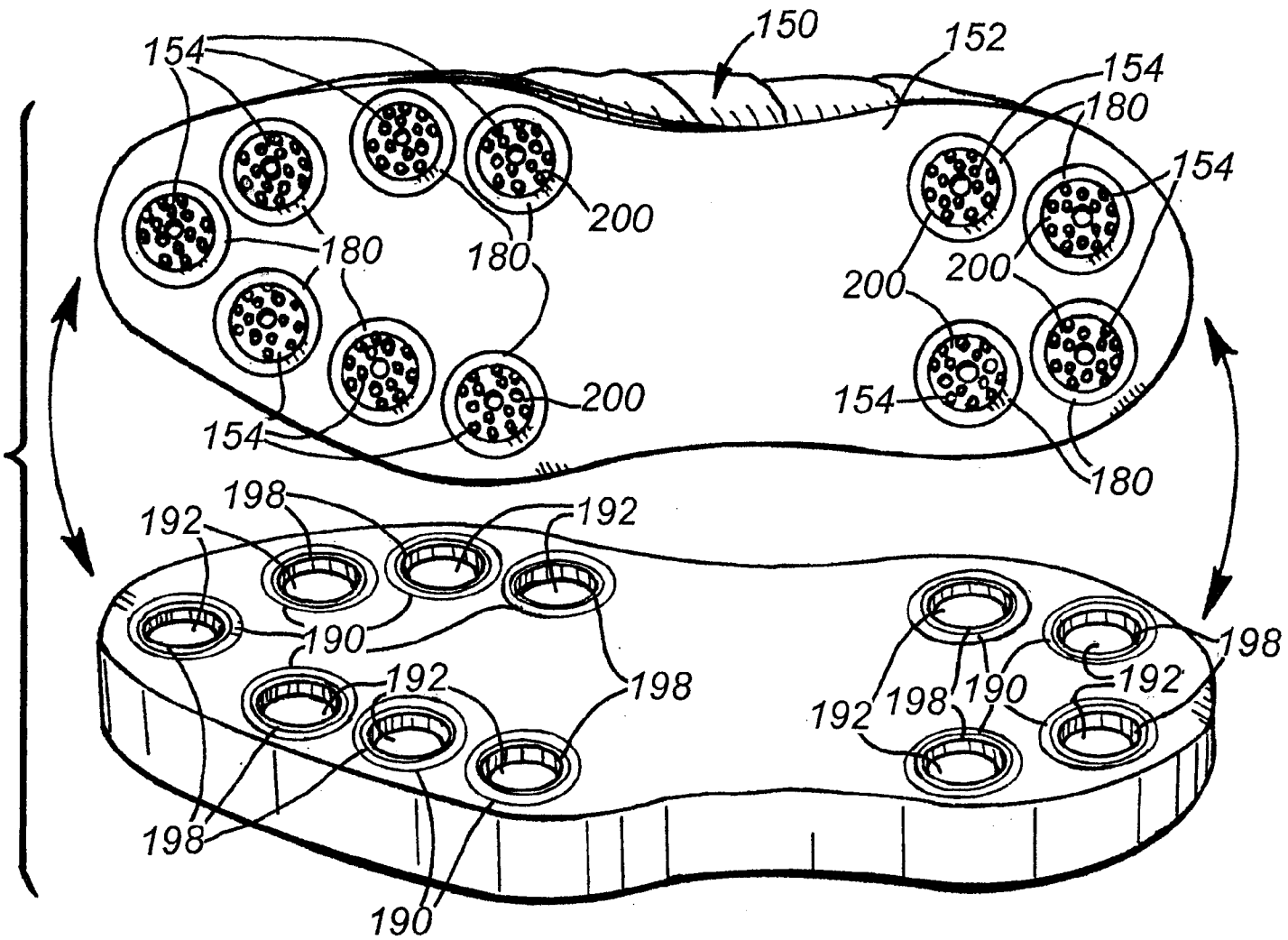
FIG. 11 is a perspective view showing the attachment of the overlying sole to the shoe base section according to FIG. 10.
Figure 12:
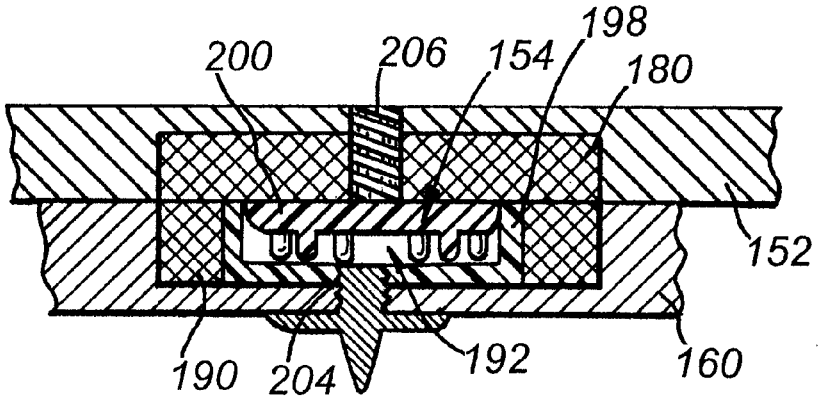
FIG. 12 is a partial cross-section showing the seating of the overlying sole having a long spike relative to the base section having a short spike for the shoe of FIG. 10.

An alternate embodiment, in which short spikes are provided to the base section, is shown in FIGS. 10–12. The shoe 150 includes a base section sole 152, constructed from materials described above that includes a set of short spikes 154 threadingly mounted into the sole 152. A pair of overlying soles 160 and 170 comprising, respectively, a long-spike sole and a spikeless sole, can be mated to the base section sole 152. With reference also to FIG. 12, the base section sole 152 includes an oversized magnetic, or magnetically attractive (e.g. steel or iron) insert 180 that is adhesively set into the sole 152. The insert has a diameter that is approximately ½ inch larger than the diameter of the spike base as detailed particularly in FIG. 11. The exact oversize of the insert diameter is variable. The insert, in this manner presents an exposed annulus of attractive material to confront the overlying sole 160 (or 170). Each overlying sole includes an opposing magnet or magnetically attractive insert 190. The insert 190 defines an annulus with an open center 192. The top of the annulus is typically flush with the confronting surface 194 (or 196) of the sole 160 (or 170). Alternatively, each of the inserts 180 and 190 can be correspondingly extended and recessed to aid in alignment of the soles. In other words, the base section insert can, for example, be extended from the face by ⅛ inch and the overlying sole insert can be recessed in the sole to ⅛ inch, and vice versa.

The hole 192 in each insert 190 enables the spike 154 to seat within the recess of the insert free of interference with the insert 190 while allowing the inserts 180 and 190 to come into attractive contact as shown in FIG. 12. The insert 190 can also include an alignment sleeve 198 for guiding each respective spike 154 into alignment. The sleeve can be frustoconically shaped or cylindrical as shown. The diameter of the sleeve 198 is the same or slightly larger than that of the spike base 200, typically. The sleeve can be constructed from metal, rubber or a durable polymer.

In this embodiment, the long spike 204, shown in FIG. 12 is located in alignment with the short spike of the base section. The long spike can be offset in an alternate embodiment to enable use of a longer threaded stem thereon, or a thinner overlying sole.

The thickness of the base section sole is approximately ½ inch in this embodiment and the overlying sole is the same. Thicknesses can be widely varied. In addition flexing structures such as the ridges described above can be provided to the overlying sole 160 or 170 according to this invention. The diameter of each insert 180 and 190 can is be approximately 1¼ inch in this embodiment, but this is variable and, in part, depends upon the desired amount of attractive force desired. The insert 180 can include a sub-sleeve with threads (not shown) for receiving the spike stem 206 when the material of the insert 180 is not considered durable enough.

Each insert is mounted into the sole (as are all other inserts described herein) using adhesives or fasteners. Alternatively, the inserts can be installed using either conventional techniques such as molding the inserts into the sole during manufacture. Various anchoring structures (not shown) can be included on the inserts to maintain them in the respective sole free of rotation and axial pull-out therefrom.

Finally, the overlying sole 170 includes a toe shield 210 (FIG. 10) any sole herein can include a toe shield, or a sidewall or heel piece that extends upwardly (not shown) to surround all or part of the base section. These projections can include appropriate clips for further attachment of the sole such as the clips 212 and 214 as shown for engaging respective shoe recesses 216 and 218. The rear clip 214 is spring-loaded row 217) to enable it to lock into the recess 218 after the front clip 212 is seated into the recess 216. Side clips 220 can also be provided. These are also spring-loaded (arrows 222) to selectively engage corresponding shoe side-recesses 224. Clips can be attached with rivets 226 or other fasteners or can be molded into the sole 170. Clips can be used alone or in conjunction with other fasteners such as the inserts 180 and 190 and together with recesses 216, 218 and 224 define a type of interengaging connector according to this invention.

The foregoing has been a detailed description of preferred embodiments of the invention. Various modifications and additions can be made without departing from the spirit and scope of the invention. For example any of the concepts disclosed herein can be used in combination with one or more of the concepts disclosed herein. While the types of pikes shown are preferred, any acceptable spike design can be substituted, and recesses and other fixtures can be adapted to accommodate such spikes. In addition while threaded spikes are shown, spikes having other attachment mechanisms are expressly contemplated. Finally, while the base section sole is shown including some type of spike, it is expressly contemplated that the base section can be spikeless and that various overlying soles can include spikes. In this arrangement, an alignment structure other than spikes, such as clips or toe/heel pieces as described above can be employed. Accordingly, this description is meant to be taken only by way of example and not to otherwise limit the scope of the invention.

What is claimed is:

1. A sport shoe having spikes comprising:

a base section sole having a plurality of metal spikes each having a threaded base and a single elongated spike point extending therefrom, each of the metal spikes being located in a respective threaded insert for removably receiving a respective base and spike point therein, the threaded insert being surrounded by a first magnetic material;

an overlying sole having a plurality of cups sized and arranged to receive each of the metal spikes when the overlying sole overlies the base section in a predetermined alignment therebetween, the cups being surrounded by a second magnetic material that is attracted to the first magnetic material whereby the overlying sole is maintained in removable engagement with the base section; and a plurality of threaded inserts located within the overlying sole and a plurality of respective short spikes, each of the short spikes having a threaded base with a plurality of spike points that are each shorter than the respective spike point of each of the metal spikes extending from the base the short spikes each being respectively removably mounted within each of the threaded inserts so that the spike points thereof extend from a face of the overlying sole opposite a face in which the cups are defined.

2. The sport shoe as set forth in claim 1 further comprising another overlying sole, wherein the other overlying sole includes a plurality of cups sized and arranged to receive each of the metal spikes when the other overlying sole overlies the base section in a predetermined alignment therebetween, the cups being surrounded by a third magnetic material that is attracted to the first magnetic material whereby the other overlying sole is maintained in removable engagement with the base section and wherein the other overlying sole includes, on a face thereof opposite a face on which the cups are defined, a spike-free surface for walking upon.

3. The sport shoe as set forth in claim 1 wherein at least one of the first magnetic material and the second magnetic material extends along substantially an entire surface of the respective overlying sole and base section.

4. The sport shoe as set forth in claim 2 wherein the other overlying sole includes holes each for receiving each respective spike point of the metal spikes so that each spike point extends through the overlying sole and exits an opposing face to thereby define short spike tips there-out-of.

* * * * *